US005807441A

United States Patent [19]

Tomida et al.

[11] Patent Number: 5,807,441

[45] Date of Patent: Sep. 15, 1998

[54] METHOD OF MANUFACTURING A SILICON STEEL SHEET HAVING IMPROVED MAGNETIC CHARACTERISTICS

[75] Inventors: Toshiro Tomida; Shigeo Uenoya, both of Osaka, Japan

[73] Assignee: Sumitomo Metal Industries, Ltd., Osaka, Japan

[21] Appl. No.: 732,894

[22] Filed: Oct. 17, 1996

Related U.S. Application Data

[63] Continuation-in-part of Ser. No. 464,639, filed as PCT/JP94/01833 Oct. 31, 1994 published as WO95/12691 Nov. 5, 1995, abandoned.

[30] Foreign Application Priority Data

Nov. 2, 1993 [JP] Japan ..... 5-274373
Oct. 14, 1994 [JP] Japan ..... 6-249401

[51] Int. Cl.[6] ..... H01F 1/04

[52] U.S. Cl. ..... 148/113; 148/278

[58] Field of Search ..... 148/113, 278

[56] References Cited

U.S. PATENT DOCUMENTS 3,932,235 1/1976 Foster ..... 148/113
4,207,123 6/1980 Reynolds et al. ..... 148/113

FOREIGN PATENT DOCUMENTS 48-32722 5/1973 Japan .
55-2751 1/1980 Japan .
59-205420 11/1984 Japan .
61-190021 8/1986 Japan ..... 148/113
1-108345 4/1989 Japan .
2-274844 11/1990 Japan .

*Primary Examiner*—John Sheehan
*Attorney, Agent, or Firm*—Burns, Doane, Swecker & Mathis, LLP

[57] ABSTRACT

A method of effectively manufacturing silicon steel sheets with highly accumulated {100} orientations having excellent magnetic characteristics by a single tight-coil annealing or multi-layer annealing. The method can be widely used in the manufacture of magnetic steel sheets. The silicon steel sheet with excellent magnetic characteristics can be obtained by subjecting a cold-rolled silicon steel sheet containing, on a weight basis, not more than 1% of C, 0.2 to 6.5% of Si, and 0.05 to 5.0% of Mn to a tight-coil annealing or a multilayer annealing together with a substance which accelerates decarburization or with a combination of a substance which accelerates decarburization and a substance which accelerates demanganization, as separators in annealing.

18 Claims, 15 Drawing Sheets

Fig. 1(a)
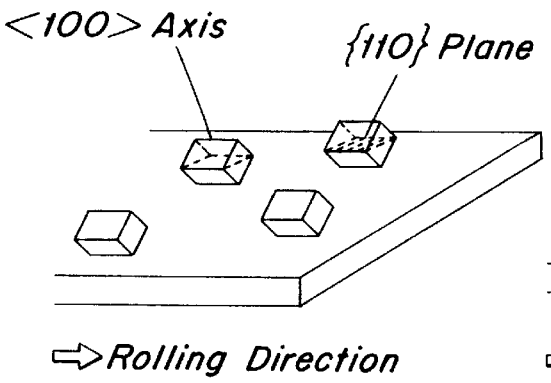
Fig. 1(b)
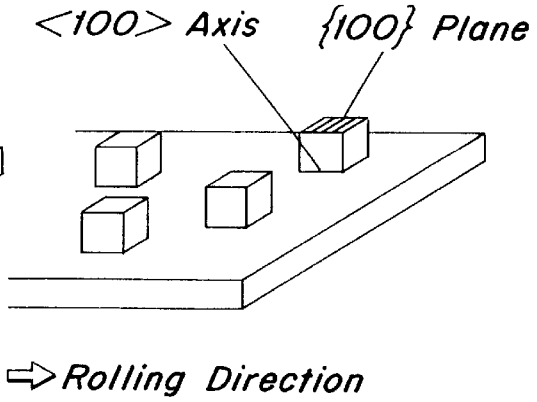
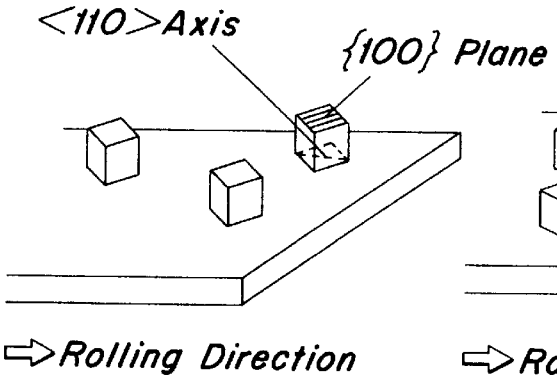
Fig. 1(c)
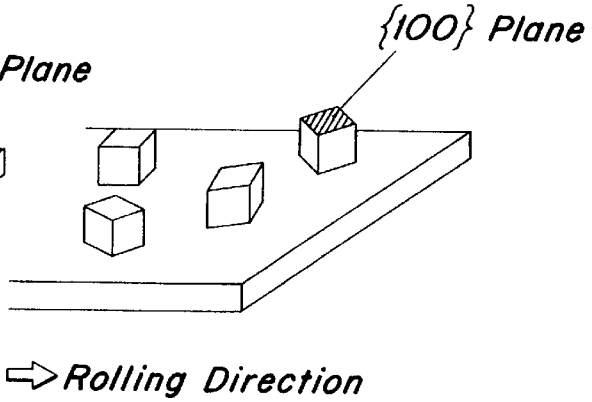
Fig. 1(d)

Fig. 7

| Steels Used | Chemical Composition (wt%, bal.: Fe, impurities) | | | | | | | | | | | | | | |
|---|---|---|---|---|---|---|---|---|---|---|---|---|---|---|---|
| | C | Si | Mn | Aℓ | P | S | Ni | Co | Cr | N | Mo | W | V | Se | Sb |
| A | 0.03 | 1.0 | 0.25 | 0.11 | 0.05 | - | - | - | 0.1 | 0.001 | 0.2 | - | - | 0.01 | 0.02 |
| B | 0.051 | 2.8 | 1.1 | - | - | - | - | - | - | - | - | - | - | - | - |
| C | 0.065 | 3.1 | 1.0 | - | - | - | - | - | - | 0.003 | - | - | - | - | - |
| D | 0.052 | 3.5 | 0.8 | - | - | 0.05 | 0.5 | - | - | 0.006 | - | 0.2 | 0.1 | - | - |
| E | 0.073 | 5.5 | 0.6 | - | - | - | - | 0.3 | - | 0.01 | - | - | - | - | - |
| F | 0.25 | 3.2 | 0.5 | 0.010 | - | - | - | - | - | 0.001 | - | - | - | - | - |
| G | 0.045 | 2.8 | 1.4 | - | - | - | - | - | - | 0.002 | - | - | - | - | - |
| H | 0.60 | 2.9 | 0.7 | 0.003 | - | - | - | - | - | 0.001 | - | - | - | - | - |
| I | 0.082 | 3.3 | 2.1 | - | - | - | - | - | - | 0.005 | - | - | - | - | - |

Fig. 8

| Classification | Steels Used | Condition of Decarburizing Annealing | | Characteristics after Annealing | | | | |
|---|---|---|---|---|---|---|---|---|
| | | Material for Decarburization | Temperature (°C) | Soaking Time (hr) | <100> Axis Density (multiple) | C Content (ppm) | Ratio of Mn Content to that before Annealing (%) |
| Invention Samples | A | 51% $SiO_2$ | 925 | 72 | 12 (25) | 15 (10) | (50) |
| | B | " | 1000 | 48 | 40 (60) | 5 ( 6) | (74) |
| | C | " | 1000 | 12 | 27 (55) | 5 ( 7) | (78) |
| | D | " | 1050 | 8 | 32 (48) | 8 (10) | (64) |
| | E | " | 1100 | 3 | 25 (53) | 12 (10) | (48) |
| | F | " | 1100 | 48 | 17 (42) | 30 (25) | (46) |
| | G | " | 1025 | 6 | 35 (68) | 6 ( 8) | (84) |
| | H | " | 1050 | 72 | 20 (39) | 38 (30) | (69) |
| | I | " | 1050 | 12 | 26 (43) | 4 ( 7) | (69) |
| Comparative Samples | A | Non-oxidizing Atmosphere | 925 | 72 | 15 | 290 | 95 |
| | B | " | 1000 | 48 | 45 | 490 | 91 |
| | C | " | 1000 | 12 | 50 | 640 | 89 |
| | D | " | 1050 | 8 | 61 | 510 | 93 |
| | E | " | 1100 | 3 | 45 | 720 | 85 |
| | F | Strong decarburizing Atmosphere | 900 | 5 | 2.4 | 17 | 99 |
| | G | " | 850 | 0.5 | 1.5 | 8 | 100 |
| | H | " | 900 | 6 | 0.8 | 14 | 99 |
| | I | " | 850 | 2 | 3.2 | 25 | 99 |
| Reference Samples | Steel A. after two times of annealing | | | | 13 | 18 | 95 |
| | Steel I. after two times of annealing | | | | 48 | 20 | 92 |
| | Commercial available high grade nonoriented silicon steel (JIS(S-9)) | | | | 2.3 | 15 | -- |

(Note) Non-oxidizing atmosphere: vacuum of $10^{-5}$ Torr
Strong decarburizing atmosphere: in hydrogen with a dew point of 30°C
Two times of annealing: 1st time (950°C, 9hrs. in vacuum)
2nd time (900°C, 2hrs. strong decarburizing atmosphere)

Fig. 9

| Classification | Steels Used | No. | Separator | | | C Content after Annealing (ppm) | Magnetic Characteristics | |
|---|---|---|---|---|---|---|---|---|
| | | | Materials (Wt%) | Shape | Density ($mg/cm^2$) | | $B_{50}$ (T) | $W_{15/50}$ (W/kg) |
| Invention Samples | I | 1 | 100% $SiO_2$ | Fiber | 50 | 3 | 1.74 | 1.52 |
| | | 2 | 50% $SiO_2$ - 50% $Al_2O_3$ | " | 25 | 5 | 1.73 | 1.57 |
| | | 3 | 5% $SiO_2$ - 95% $Al_2O_3$ | " | 10 | 15 | 1.74 | 1.62 |
| | | 4 | 90% $SiO_2$ - 10% $Cr_2O_3$ | " | 5 | 7 | 1.71 | 1.63 |
| | | 5 | 50% $SiO_2$ - 50% FeO | Powder | 1 | 6 | 1.70 | 1.68 |
| | | 6 | 3% $SiO_2$ - 90% $Al_2O_3$ - 7% $Na_2CO_3$ | Fiber | 0.1 | 20 | 1.69 | 1.71 |
| | | 7 | 3% $SiO_2$ - 90% $Al_2O_3$ - 7% $Na_2CO_3$ | " | 0.05 | 25 | 1.68 | 1.74 |
| Comparative Samples | I | 8 | 100% $Al_2O_3$ | Fiber | 10 | 810 | 1.42 | $\geq 10$ |
| | | 9 | Non-oxidizing Atmosphere | | | 800 | 1.41 | $\geq 10$ |
| | | 10 | Strong Decarburizing Atmosphere | | | 15 | 1.58 | 3.8 |
| | C | 11 | 100% $Al_2O_3$ | Fiber | | 630 | 1.38 | $\geq 10$ |
| | | 12 | Non-oxidizing Atmosphere | | | 620 | 1.37 | $\geq 10$ |
| | | 13 | Strong Decarburizing Atmosphere | | | 12 | 1.60 | 4.1 |
| Reference Samples | | 14 | Steel A. after two times of annealing | | | 14 | 1.79 | 3.6 |
| | | 15 | Steel I. after two times of annealing | | | 13 | 1.75 | 1.48 |
| | | 16 | Commercial available high grade nonoriented silicon steel (JIS(S-9)) | | - | - | 1.64 | 2.71 |

Fig. 10

| Classification | Steels Used | Condition of Decarburizing Annealing | | | C Content after Annealing (ppm) | Magnetic Characteristics | |
|---|---|---|---|---|---|---|---|
| | | Temperature (°C) | Soaking Time (hr) | Degree of Vacuum (Torr) | | $B_{50}$ (T) | $W_{15/50}$ (W/kg) |
| Invention Samples | G | 925 | 72 | 2.0 | 8 | 1.68 | 1.85 |
| | | 950 | 48 | 0.1 | 12 | 1.70 | 1.71 |
| | | 970 | 27 | 0.05 | 7 | 1.71 | 1.65 |
| | | 1000 | 15 | $10^{-3}$ | 9 | 1.72 | 1.62 |
| | | 1025 | 10 | $10^{-5}$ | 10 | 1.73 | 1.56 |
| | | 1050 | 12 | $10^{-2}$ | 5 | 1.76 | 1.51 |
| | | 1100 | 6 | 5 | 3 | 1.68 | 1.82 |
| Comparative Samples | G | 900 | 0.5 | $10^{-2}$ | 410 | 1.37 | $\geq 10$ |
| | | 1150 | 2 | 200 | 32 | 1.56 | 5.9 |
| Reference Samples | Steel A, after two times of annealing | | | | 14 | 1.79 | 3.6 |
| | Steel G, after two times of annealing | | | | 24 | 1.75 | 1.55 |
| | Commercial available high grade nonoriented silicon steel (JIS(S-9)) | | | | | 1.64 | 2.71 |

Fig. 12

| Classification | Steels Used | Chemical Composition (wt%, bal.: Fe. impurities) | | | | | | | | | | | | |
|---|---|---|---|---|---|---|---|---|---|---|---|---|---|---|
| | | C | Si | Mn | Aℓ | P | S | Ni | Co | N | Mo | W | V | Se |
| Invention Samples | J | 0.02 | 0.8 | 0.16 | 0.11 | 0.05 | - | - | 0.3 | 0.002 | - | - | - | - |
| | K | 0.25 | 1.6 | 0.44 | - | - | 0.051 | - | - | 0.002 | 0.2 | - | 0.2 | - |
| | L | 0.06 | 1.8 | 0.85 | - | - | 0.005 | - | - | - | - | - | - | - |
| | M | 0.15 | 2.1 | 1.41 | - | - | 0.003 | - | - | 0.008 | - | - | - | - |
| | N | 0.04 | 2.5 | 0.65 | - | - | - | - | - | 0.004 | - | - | - | - |
| | O | 0.05 | 2.8 | 0.92 | - | - | - | - | - | 0.001 | - | - | - | - |
| | P | 0.07 | 3.3 | 1.24 | - | - | - | - | - | 0.006 | - | - | - | - |
| | Q | 0.06 | 3.5 | 1.1 | - | - | 0.012 | - | - | 0.002 | - | - | - | - |
| | R | 0.09 | 4.5 | 0.61 | - | - | - | 0.5 | - | 0.004 | - | 0.2 | - | 0.0101 |
| | S | 0.35 | 4.5 | 3.5 | - | - | - | - | - | - | - | - | - | - |
| | T | 0.15 | 4.7 | 2.1 | 0.02 | - | - | - | - | - | - | - | - | - |
| Comparative Samples | J-H | - | 0.8 | 0.16 | 0.11 | 0.05 | - | - | 0.3 | 0.002 | - | - | - | - |
| | K-H | - | 1.6 | 0.44 | - | - | 0.045 | - | - | 0.002 | 0.2 | - | 0.2 | - |
| | O-H | - | 2.8 | 0.92 | - | - | - | - | - | 0.001 | - | - | - | - |
| | P-H | - | 3.3 | 1.24 | - | - | - | - | - | 0.004 | - | - | - | - |
| | R-H | - | 4.5 | 0.61 | - | - | - | 0.5 | - | 0.005 | - | 0.2 | - | 0.0101 |
| | S-H | - | 4.5 | 3.5 | - | - | - | - | - | - | - | - | - | - |
| | O-M | 0.05 | 2.8 | - | - | - | - | - | - | 0.001 | - | - | - | - |

Fig. 13

| Classification | Steels Used | Condition of Decarburizing Annealing | | Mn Content (wt%) | | C Content (ppm) | <100> Axis Density (multiple) | Magnetic Characteristics | |
|---|---|---|---|---|---|---|---|---|---|
| | | Temperature (°C) | Soaking Time (hr) | Test Samples | Demanganization Accelerator | | | $B_{50}$ (T) | $W_{15/50}$ (W/kg) |
| Invention Samples | J | 950 | 24 | 0.04(0.13) | 0.1 | 10(15) | 24 ( 7) | 1.83 (1.77) | 5.42 (6.51) |
| | K | 1050 | 48 | 0.15(0.42) | 0.22 | 26( 5) | 28 (16) | 1.81 (1.75) | 3.21 (4.10) |
| | L | 1000 | 5 | 0.72(0.80) | 0.1 | 29(12) | 35 (20) | 1.78 (1.74) | 2.85 (3.62) |
| | M | 975 | 50 | 1.03(1.35) | 0.31 | 32(10) | 30 (14) | 1.75 (1.69) | 2.62 (3.40) |
| | N | 1125 | 2 | 0.42(0.58) | 0.18 | 5( 8) | 38 (18) | 1.80 (1.74) | 1.95 (2.50) |
| | O | 1050 | 12 | 0.72(0.87) | 0.18 | 15(15) | 52 (12) | 1.79 (1.71) | 1.57 (1.92) |
| | P | 1100 | 4 | 0.93(1.16) | 0.27 | 20(17) | 42 (14) | 1.77 (1.70) | 1.48 (1.88) |
| | Q | 1025 | 15 | 0.75(1.03) | 0.25 | 15(13) | 52 (13) | 1.76 (1.70) | 1.40 (1.72) |
| | R | 1000 | 24 | 0.39(0.58) | 0.19 | 25(15) | 33 ( 8) | 1.73 (1.68) | 1.30 (1.75) |
| | S | 1075 | 35 | 2.70(2.98) | 0.31 | 18(13) | 18 ( 6) | 1.63 (1.57) | 1.27 (1.48) |
| | T | 1150 | 0.5 | 1.72(2.01) | 0.28 | 8(14) | 40 (13) | 1.68 (1.63) | 1.05 (1.34) |
| Comparative Samples | J-H | 950 | 24 | 0.06 | 0.07 | – | 1.2 | 1.74 | 7.35 |
| | K-H | 1050 | 48 | 0.16 | 0.20 | – | 0.7 | 1.7 | 4.92 |
| | O-H | 1050 | 12 | 0.73 | 0.12 | – | 2.1 | 1.65 | 2.44 |
| | P-H | 1100 | 4 | 1.08 | 0.30 | – | 0.8 | 1.62 | 2.53 |
| | R-H | 1000 | 24 | 0.37 | 0.20 | – | 2.4 | 1.59 | 1.97 |
| | S-H | 1075 | 35 | 2.74 | 0.34 | – | 2.1 | 1.53 | 1.78 |
| Reference Samples | JIS(S-20) High grade nonoriented silicon steel, composition corresponding to 2%Si | | | | | | 1.7 | 1.68 | 4.25 |
| | JIS(S-9) High grade nonoriented silicon steel, composition corresponding to 3%Si | | | | | | 2.3 | 1.64 | 2.84 |

Fig. 14

| Classification | No. | Steels Used | Thickness (mm) | $TiO_2$ Fill ($mg/cm^2$) | Control after Annealing | | <100> Axis Density (Multiple with Respect to the Nonoriented Sample) |
|---|---|---|---|---|---|---|---|
| | | | | | C(ppm) | Mn(wt%) | |
| Invention Samples | 1 | O | 0.5 | 10 | 20 | 0.75 | 48 |
| | 2 | " | 0.4 | 5 | 15 | 0.7 | 35 |
| | 3 | " | 0.35 | 8 | 13 | 0.52 | 56 |
| | 4 | " | 0.35 | 4 | 12 | 0.53 | 43 |
| | 5 | " | 0.35 | 2 | 9 | 0.56 | 62 |
| | 6 | " | 0.35 | 1 | 12 | 0.62 | 45 |
| | 7 | " | 0.3 | 2 | 10 | 0.51 | 56 |
| | 8 | " | 0.25 | 2 | 8 | 0.48 | 42 |
| | 9 | " | 0.2 | 0.8 | 5 | 0.53 | 65 |
| | 10 | " | 0.15 | 0.5 | 4 | 0.62 | 58 |

Fig. 18

| Steel Species | Contents after Annealing | | <100> Axis Density (Multiple with Respect to the Nonoriented Sample) | Magnetic Characteristics | | | | Remarks |
|---|---|---|---|---|---|---|---|---|
| | C (ppm) | Mn (wt%) | | $B_{10}$ (T) | $B_{50}$ (T) | $W_{10/50}$ (W/kg) | $W_{15/50}$ (W/kg) | |
| Sample | 15 | 0.46 | 46 | 1.58 | 1.78 | 0.72 | 1.95 | Invention Material 0.5mm |
| S-9 | - | - | 2.5 | 1.44 | 1.65 | 1.05 | 2.8 | Comparative Material 0.5mm |
| (Note) S-9: Commercially available JIS high grade nonoriented silicon steel | | | | | | | | |

METHOD OF MANUFACTURING A SILICON STEEL SHEET HAVING IMPROVED MAGNETIC CHARACTERISTICS

This application is a Continuation-In-Part, of Application No. 08/464,639, filed Jun. 20, 1995 now abandoned, which is a 371 of PCT/JP94/01833, filed Oct. 31, 1994, filed as WO95/12691 Nov. 5, 1995.

TECHNICAL FIELD

The present invention relates to a method of manufacturing a silicon steel sheet which has excellent magnetic characteristics and which has {100} planes parallel to the surface of the sheet.

BACKGROUND ART

Silicon steel sheets have conventionally been used as magnetic core materials for electric motors, generators, transformers, etc. Silicon steel sheets require two major properties: a reduced magnetic energy loss in AC magnetic fields and a high flux density in magnetic fields. These characteristics are effectively achieved by enhancing the electrical resistance of the sheets, and in addition, by causing their axis of easy magnetization, <100> axis of the bcc lattice, to have an orientation the same as the direction of the magnetic field in which the sheets are used.

Under circumstances where the magnetic field is always applied in one direction only (such as in transformers), oriented silicon steel sheets containing about 3% of Si are very frequently used because they are regarded as providing the most effective magnetic characteristics.

FIG. 1 is an explanatory illustration showing the rolled direction of a silicon steel sheet and orientations of <100> and <110> axes and {100} and {110} planes of a bcc lattice. FIG. 1(*a*) depicts an oriented silicon steel sheet with its {110} planes parallel to the surface of the sheet and with its <100> axes generally oriented in the direction of rolling. Since the axis of easy magnetization of silicon steel is <100>, oriented silicon sheets as shown in FIG. 1(*a*) exhibit remarkable magnetic characteristics when they are used in a magnetic field applied in the direction of rolling. However, they are difficult to magnetize in directions other than the rolling direction. Therefore, they cannot provide desired effects if used under conditions where the magnetic field is applied in a variety of directions with respect to the surface of the sheet as in rotating machines such as motors and generators.

Silicon steel sheets which are currently in use in apparatuses in which the magnetic field is applied to the surfaces of the sheets in a plurality of directions are, in most cases, nonoriented silicon steel sheets with almost no oriented texture. In such silicon steel sheets, however, most <100> axes are not parallel to the surface of the sheet. Therefore, good magnetic characteristics cannot be obtained.

Sheets which exhibit excellent magnetic characteristics in the above-mentioned applications have their {100} planes parallel to the surface of the sheet and <100> axes perpendicular to the surface to the sheet, as shown in FIGS. 1(*b*) to 1(*d*). When a sheet has this texture, two out of three <100> axes which intersect at right angles to each other are parallel to the surface of the sheet. Hereinafter, in this invention, silicon steel sheets with any one of these three types of textures are collectively called silicon steel sheets having a {100} texture.

Nonoriented silicon steel sheets having a {100} texture have different end uses depending on the accumulation degree of orientation of two <100> axes which are parallel to the surface of the sheet.

For example, in the case where EI-type iron cores in which magnetic fields are applied in directions intersecting at right angles are manufactured, textures of {100} <100> and {100} <110> as shown in FIGS. 1(*b*) and 1(*c*) are preferred. By contrast, in the case where iron cores in which magnetic fields are applied to the sheets from every direction are manufactured, it is preferred that either the texture of FIG. 1(*d*) in which {100} planes are parallel to the surface of the sheet with no orientation or the texture of FIG. 1(*b*) or 1(*c*) in which {100} planes are aligned be subjected to a blanking in varying directions, and that the blanked pieces be superposed to one another.

The present inventors have already disclosed, in Japanese Patent Application Laid-open (kokai) No. 108345/1989, a process for manufacturing a silicon steel sheet suitable for realizing a {100} texture on an industrial scale by employing two-stage decarburizing annealing.

According to this process, a cold rolled silicon steel sheet containing 0.02 to 1% of C, 0.2 to 6.5% of Si, and if necessary, not more than 5% of Mn in which at least a substantially single α-ferrite phase is formed at temperatures not higher than 850° C. after decarburization is decarburized to a carbon content of 0.01% or less at a temperature which generates a substantially single α-ferrite phase after decarburization. This process manufactures a silicon steel sheet composed of columnar crystals which have grown in the perpendicular direction with respect to the sheet surface from the surface toward the inside of the sheet with the axes <100> being densely accumulated in the direction perpendicular to the sheet. In the present specification, the expression "substantially single a-ferrite phase" means that trace amounts of secondary phases of MnS, AlN, and the like may also be present.

According to this process, a primary decarburizing annealing (for example, a soaking temperature of 950° C. and a soaking period of 5 hours) is first carried out in a vacuum or in a weak decarburizing atmosphere to generate α-ferrite grains having <100> axes perpendicular to the sheet surface in a range essentially from the surface to 5 to 50 μm beneath the surface, and thereafter, a secondary decarburizing annealing (for example, a soaking temperature of 850° C. and a soaking period of 2 hours) is carried out in a strong decarburizing atmosphere to allow the α-ferrite grains to grow toward the inside of the sheet.

The reasons why α-ferrite grains having <100> axes perpendicular to the sheet surface are generated densely in the surface portion of the sheet are the following 1) and 2): 1) mild decarburizing in a weak decarburizing atmosphere and manganese removal, if Mn is contained, cause a gamma-to-alpha transformation in the surface portion of the sheet to generate a domain which is composed only of α-ferrite grains, and 2) among the α-ferrite grains, those having <100> axes perpendicular to the sheet surface are selectively allowed to grow by the planes surface energy which makes {100} the most stable.

FIG. 2 is a schematic illustration which shows the developing {100} texture in the sheet surface. Beneath the surface is a two-phase (alpha+gamma) co-existing texture, and the surface portion is an α-ferrite single phase.

The process 1) above is achieved as a result of a selective growth of an α-ferrite single phase due to the fact that the surface energy of α-ferrite crystal grains in {100} of the surface layer which have turned to an α-ferrite single phase is smaller than that attributed to other orientations.

The driving force for urging a selective growth due to the surface energy is proportional to the ratio Δ E/d of the difference in surface energy from the circumferential grains (Δ E) and the thickness of the surface layer (d). That is, since the driving force increases when the surface layer composed of an α-ferrite single phase is thin, when an α-ferrite single phase is generated by annealing, a {100} texture develops at the initial period of annealing when the surface texture of the α-ferrite single phase is thin. In other words, in order to have a {100} texture developed, it is necessary that a layer composed of an α-ferrite single phase be immediately formed in the surface during the initial stage of annealing, and decarburization and demanganization be controlled so that the thickness of the surface layer does not increase until the texture has been sufficiently developed. Moreover, if the boundary which delimits the surface layer composed of an α-ferrite single phase from the inside is not clear, {100} grains in the surface layer will not grow in an efficient manner.

In the method which the present inventors disclosed in Japanese Patent Application Laid-open (kokai) No. 108345/1989, an open coil method is employed in a primary decarburizing annealing stage, and an open coil method or a continuous annealing is employed in a secondary decarburizing annealing stage. The open coil method has the drawback in terms of quality that the steel sheet is buckled during annealing. Because primary annealing is generally carried out at a temperature not lower than 900° C. buckling easily occurs. Especially, elongated materials are vulnerable to buckling. On the other hand, the continuous annealing method has the problem of increased facility costs because a longer annealing vessel is required to perform a relatively long annealing. Due to these problems, conventional manufacturing processes are not effective from the aspects of productivity, manufacturing costs, and quality.

In case the above-mentioned primary and secondary decarburizing annealings are attempted by a single annealing operation, the following problem occurs. Namely, since the atmosphere of the primary annealing provides very weak decarburizing effects, it cannot be used as an atmosphere in the secondary annealing stage. In addition, the strong decarburizing atmosphere of the secondary annealing stage strongly oxidizes Si and Mn in steel sheet to form an oxidized layer in the surface of the sheet. Therefore, if this atmosphere is used as a primary annealing atmosphere, {100} texture cannot be developed, which inevitably requires a two-stage annealing including primary and secondary decarburizing annealing processes.

DISCLOSURE OF THE INVENTION

An object of the present invention is to solve the above-mentioned problems conventionally experienced, and to provide a method for manufacturing a silicon steel sheet with {100} textures by a single annealing process. The present inventors found that when a substance which accelerates decarburization, or a combination of a substance which accelerates decarburization and a substance which accelerates demanganization, is placed between layers of a coil or between sheets as a separator and is annealed, only one annealing process is needed for achieving the gamma-to-alpha transformation, {100} planes can be developed parallel to the surface of the sheet, and in addition, <100> axes can be formed perpendicular to the sheet surface to urge growth of α-ferrite grains toward the center core of the sheet. The present invention was accomplished based on these findings. Furthermore, according to this manufacturing method, even elongated steel sheets can be satisfactorily manufactured without causing buckling.

The gist of the present invention resides in the following methods 1) and 2) of manufacturing silicon steel sheets.

1) A method of manufacturing a silicon steel sheet with excellent magnetic characteristics which comprises subjecting a cold-rolled silicon steel sheet containing, on a weight basis, not more than 1% of C, 0.2 to 6.5% of Si, and 0.05 to 5.0% of Mn to a tight-coil annealing or a multilayer annealing together with a substance which accelerates decarburization and which serves as a separator in annealing.

2) A method of manufacturing a silicon steel sheet with excellent magnetic characteristics, which comprises subjecting a cold rolled silicon steel sheet with the above-mentioned composition to a tight-coil annealing or a multilayer annealing together with a substance which accelerates decarburization and a substance which accelerates demanganization, both substances serving as separators in annealing.

BRIEF DESCRIPTION OF DRAWINGS

FIGS. 1*a–d* provide an explanatory illustration showing the rolled direction of a silicon steel sheet and the distinction in the general orientation of <100> and <110> axes and {100} and {110} planes of a bcc lattice.

FIG. 7 is a table showing compositions of 9 kinds of ingots which were manufactured by vacuum casting and were used in Examples 1 to 4 as test samples.

FIG. 8 shows the conditions of the decarburizing annealing in Example 1 and the characteristics obtained after annealing; FIG. 9 shows the specifications of the separators used in Example 2, carbon content after annealing, and magnetic characteristics; and FIG. 10 shows the conditions of the decarburizing annealing in Example 3, carbon content after annealing, and magnetic characteristics.

FIG. 12 is a table which shows chemical compositions of 18 kinds of ingots which were manufactured by vacuum casting and were used in Examples 5 to 8 as test samples.

FIG. 13 is a table which shows the amounts of Mn and C, <100> axis density, and magnetic characteristics after the decarburizing annealing in Example 5, and FIG. 14 is a table which shows the amounts of Mn and C and <100> axis density after the decarburizing annealing in Example 6.

FIG. 18 is a table which shows the amounts of Mn and C, <100> axis density, and magnetic characteristics after annealing.

BEST MODE FOR CARRYING OUT THE INVENTION

Figure 2:
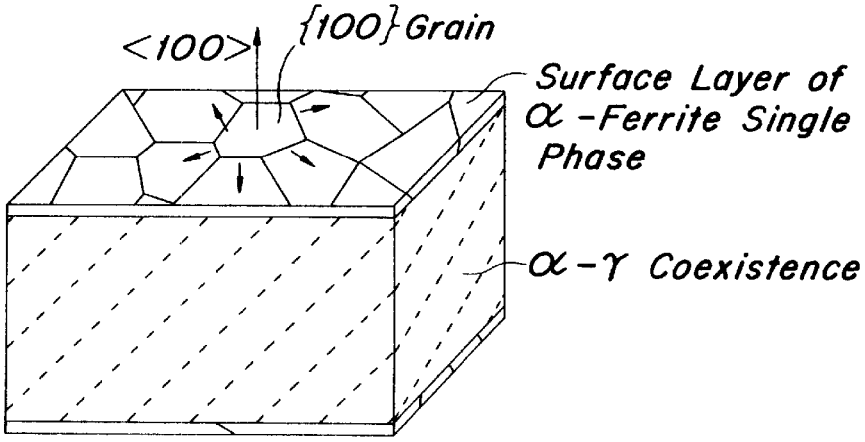
FIG. 2 is a schematic illustration which shows the growth of a {100} texture in the sheet surface.

I. Use of a substance which accelerates decarburization as a separator in annealing:

When a substance which accelerates decarburization is placed between the layers of steel sheets as a separator in annealing and a tight-coil annealing or a multilayer annealing is carried out, decarburization is induced while preventing the surface of the steel sheet from being oxidized. During this process, gamma-to-alpha transformation is caused to develop a strong {100} texture in the surface of the sheet. The decarburization reaction occurs at a sufficiently high speed. When annealing is continued, crystals having a {100} texture can be grown toward the inside of the sheet within a practically useful annealing time, thereby providing the entire sheet with a {100} texture.

Examples of the substance which accelerates decarburization include $SiO_2$, an oxide of silicon. Decarburization accelerated by $SiO_2$ as a separator in annealing is speculated to have the following mechanism.

Although the silicon oxide is stable at room temperature, it becomes unstable when the temperature goes up to approximately 1000° C. to cause the following decomposition reaction which generates oxygen.

$$SiO_2 \rightarrow SiO + O \quad 1)$$

The oxygen generated by this reaction reacts with C in steel sheet as shown by scheme 2) below, producing carbon monoxide gas to achieve decarburization.

$$O + C \text{ (in steel sheet)} \rightarrow CO \text{ (gas)} \quad 2)$$

According to the experiments conducted by the present inventors, the decarburization reaction of scheme 2) intensely takes place at the contact point between the oxide and the steel sheet. In addition, the oxygen generated by the reaction of scheme 1) does not react with the carbon present inside the steel sheet but directly reacts with the carbon present in the surface of the steel sheet in the state of O (atomic oxygen) as shown in scheme 2). This indicates that the reactions of schemes 1) and 2) have features of solid-state reactions.

There are other substances that exhibit the above function, which include $Cr_2O_3$, FeO, and $Na_2CO_3$. They are relatively unstable oxides at a high temperature in a certain proper atmosphere. In other words, they are compounds which decompose at an annealing temperature to generate oxygen which accelerates decarburization. They may be used in combination of two or more species. It is also possible to use one species or a mixture of two or more species together with inorganic materials which are stable at a high temperature, including stable oxides such as $Al_2O_3$ and stable nitrides and carbides such as BN and SiC.

$Na_2CO_3$, however, is unstable compared with $SiO_2$, and quickly decomposes at high temperatures. As a result, it generates a large amount of oxygen, oxidizing the Si and Mn present in the steel sheet and inducing oxidation in the surface. Therefore, $Na_2CO_3$ must not be used solely, or its amount must be restricted.

The most preferable substances are those containing $SiO_2$. Since $SiO_2$ accelerates decarburization without causing surface oxidization of the steel sheet due to its decomposition temperature and the amount of oxygen generated, it is the most suitable substance which accelerates the development of the {100} texture.

The oxygen (O) generated from the decarburization accelerator oxidizes Mn in the steel sheet to degrade the surface properties. Therefore, when a steel sheet containing Mn is annealed, the combined use with another decarburization accelerator which promotes demanganization is suggested based on that Mn which stabilizes the gamma phase decreases from the surface of the steel sheet to promote gamma-to-alpha transformation and to inhibit oxidation of Mn. Mn, which is not oxidized, activates the surface of the steel sheet to accelerate the decarburization reaction of scheme 2). Moreover, removal of Mn may further be carried out to accelerate gamma-to-alpha transformation in the surface.

The form of the annealing separator containing a substance which accelerates decarburization is not particularly limited. It may take the form of plates, powders, fibrous materials, sheets made of fibers, or sheets containing powders. Most preferably, the separator is a fibrous material or a sheet composed of fibers. This is because fibrous materials or sheets composed of fibers do not fall from the interlayers of the coil, and oxygen is not abundantly adsorbed onto the surface, both of which happen when powders are used. In addition, voids present among the fibers function to easily discharge carbon monoxide generated by the aforementioned reaction, and surface gamma-to-alpha transformation is accelerated due to the sublimation of Mn in the voids. The fibrous material or sheet may be inserted in between layers of the coil or between the steel sheets to be annealed.

Figure 3:
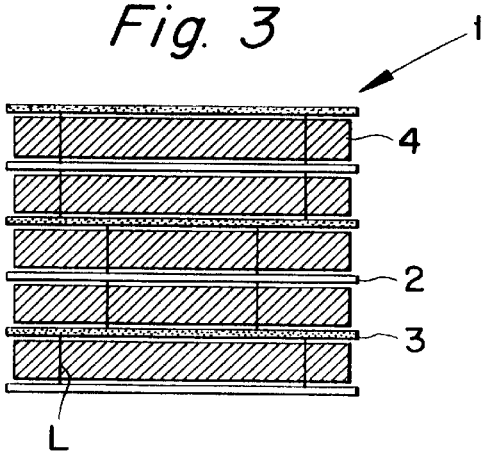
FIG. 3 is a schematic illustration showing a structure of a layered body which was used in an annealing test.

II. Combined use, as a separator in annealing, of a substance which accelerates decarburization and a substance which accelerates demanganization:

In the above, we explained that the presence of Mn in a steel sheet allows Mn to sublime from the surface of the steel sheet during annealing, to promote gamma-to-alpha transformation in the surface layer of the steel sheet, resulting in the development of a {100} texture. We further conducted research focusing on the sublimation of Mn (demanganization), and as a result, found that the combined use of a substance which accelerates decarburization and a substance which accelerates demanganization, both as separators in annealing, easily forms {100} textures which are highly accumulated. In this specification, the results of a few simple experiments will be described. FIG. 3 is a schematic illustration showing a structure of a layered body which was used in an annealing test. In FIG. 3, 1 denotes a layered body, 2 denotes a test sheet, 3 denotes a demanganization accelerator, and 4 denotes a decarburization accelerator. The layered body 1 was constructed by laying a test sheet 2 (Mn-containing silicon steel sheet), a steel sheet 3 for accelerating removal of Mn (free of Mn, a substance which accelerates demanganization), and a decarburization accelerator, using decarburization accelerators 4 as separators. When the layered body is subjected to a vacuum annealing (under conditions such as 1000° C. for 12 hours), Mn sublimed from the test sheet passes through the decarburization accelerators as shown by arrows L, and is absorbed by the steel sheet for accelerating demanganization. This reaction is confirmed by the fact that a large amount of Mn is present in the Mn removal accelerating steel sheet after annealing, or by the fact that Mn is removed in greater amounts from the test sheet when annealing is carried out as above than is carried out using a decarburization accelerator solely with absence of a Mn removal accelerating steel sheet.

When demanganization is accelerated, the aforementioned effect obtained in the first stage during which {100} textures are formed (gamma-to-alpha transformation is caused in the surface layer to selectively grow {100} grains therein by the surface energy to laterally develop the {100} texture) is even enhanced. Examples of the Mn removal accelerator include Mn-free iron-base alloys, iron-base alloys containing Mn in less amount than the Mn content of a silicon steel sheet (preferably not more than ½ of the Mn content of a silicon steel), and oxides which absorb Mn (for example, an oxide such as $TiO_2$ which forms a complex compound). That is, any substance that is capable of absorbing Mn subliming from the steel sheet during annealing and that does not adversely affect the decarburization reaction or the surface energy state of the steel sheet can be used. The shape of the Mn removal accelerator is not particularly limited, including powders, fibers and plates. The composition of the iron-base alloy is preferably such that the Mn content is less than that of a silicon steel sheet and other components are in proportions the same as those of the silicon steel sheet.

$TiO_2$, a substance which accelerates demanganization, forms a complex oxide $TiMnO_2$ together with Mn which sublimes from the steel sheet to absorb Mn. The oxide for accelerating demanganization may be used as a mixture with a separator for accelerating decarburization, and in this case, more effective decarburization annealing can be achieved than the case where an iron-base alloy sheet is used.

Next, the mechanism of generating {100} textures during annealing under co-existence of a decarburization accelerator and a Mn removal accelerator will be described.

Figure 4:
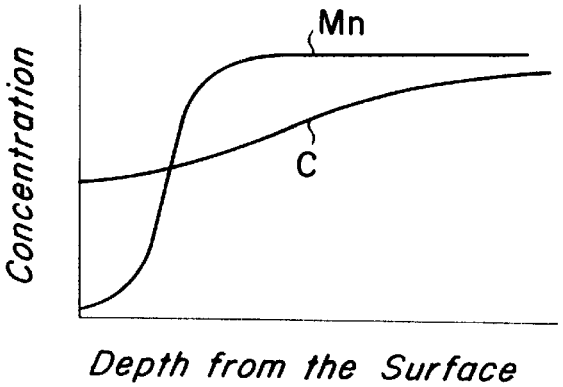
FIG. 4 is a graph showing the concentration profiles of C and Mn which have been diffused in the sheet by annealing.
Figure 5A:
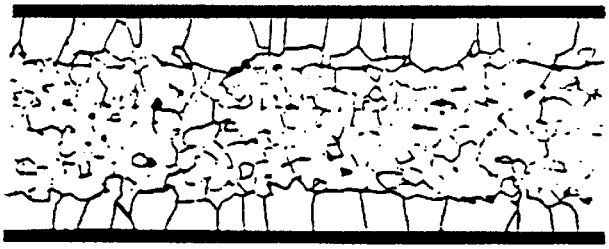
FIGS. 5*a–e* and 6*a–e* are sketches of the microstructures obtained by annealing materials containing different amounts of Mn in the presence of a decarburization accelerator and a demanganization accelerator. The illustrations of FIG. 5 show microstructures where a silicon steel sheet containing 0.92% of Mn was annealed, and the illustrations of FIG. 6 show those in the case where a Mn-free silicon steel sheet was annealed.
Figure 5B:
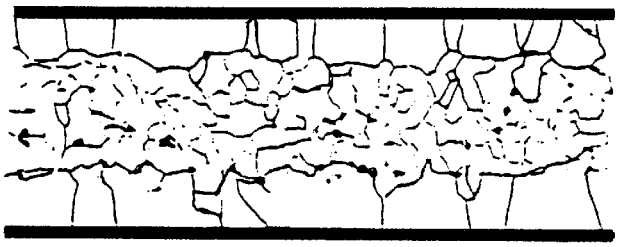
Figure 5C:
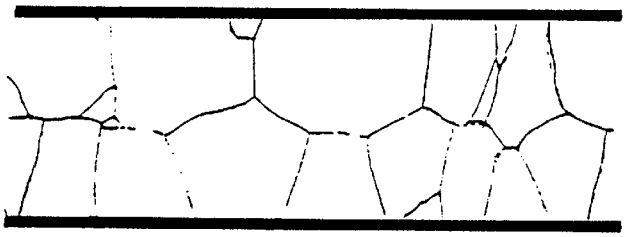
Figure 5D:
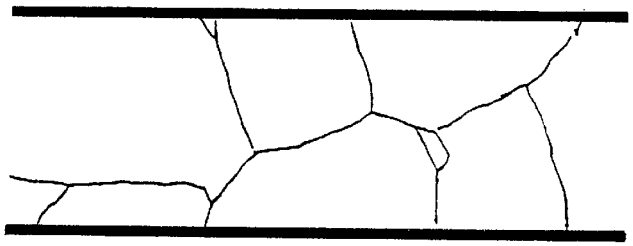
Figure 5E:
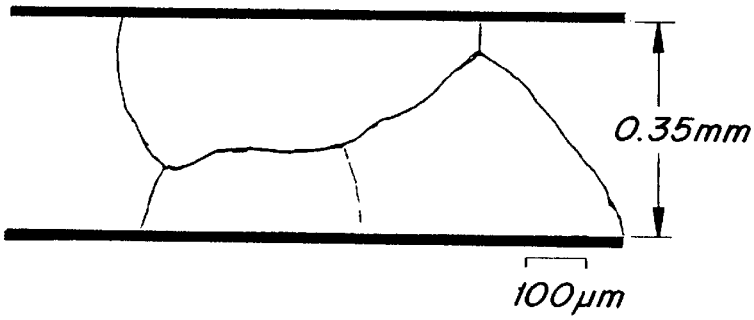
Figure 6A:
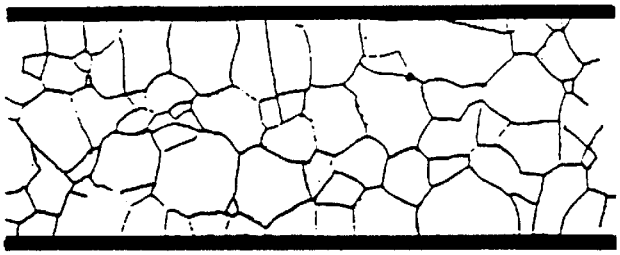
Figure 6B:
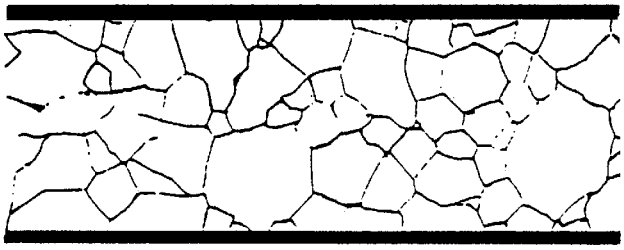
Figure 6C:
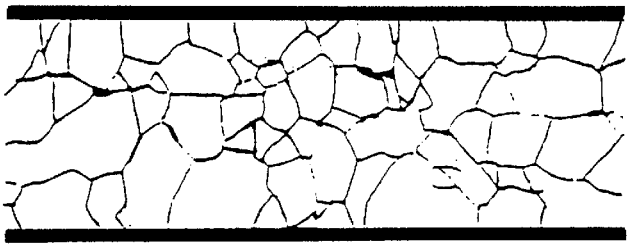
Figure 6D:
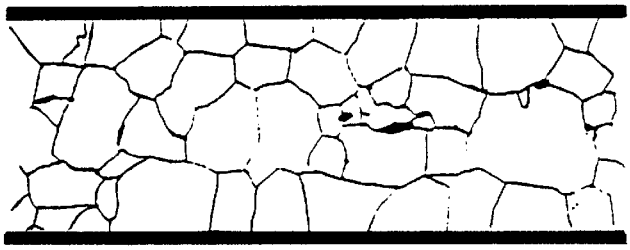
Figure 6E:
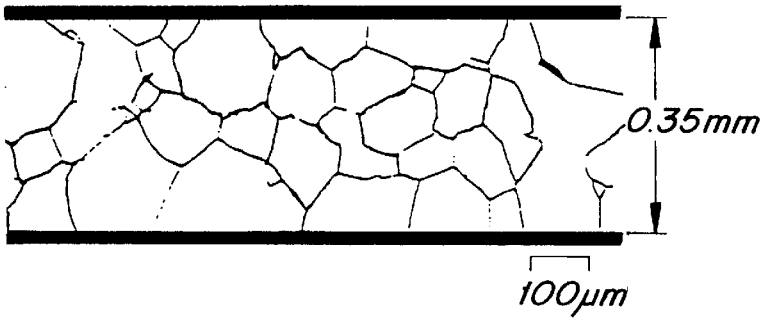

FIG. 4 is a graph showing the concentration profiles of C and Mn which have been diffused in the sheet by annealing. The symbol C shows the concentration curve when decarburization was performed solely, and the symbol Mn shows when demanganization was performed solely. When annealing is performed around the temperature of 1000° C. and therefore only decarburization proceeds, carbon concentration curves of this type are obtained. Since carbon has a very high diffusion speed, difference in the carbon concentration between the surface and the inside is small. Therefore, a surface texture composed only of α-ferrite phase cannot be formed, or, if formed, the boundary which delimits the surface layer composed of an α-ferrite single phase from the inside (alpha+gamma, or gamma) is not clear and the surface layer does not obtain a full development of {100} textures.

By contrast, Mn has a diffusion speed much smaller than that of C, and therefore, it can form a region of low Mn concentration having a steep concentration gradient, (or having a clear boundary between the surface layer in which the Mn concentration is low and the inside in which the Mn concentration is high), in the vicinity of the surface as a result of demanganization.

Reduction in the amount of Mn in an annealing process employing a demanganization accelerator increases the chemical potential of C in the region of low Mn content area. As a result, carbon in this region (the surface layer in which Mn is contained in low amounts) is diffused to the region of high Mn content (the inside of the sheet) to induce a gamma-to-alpha transformation and turn the region into an α-ferrite single phase.

The surface layer which is formed by demanganization does not become thick even after a prolonged period of annealing because Mn has a small diffusion speed (about 100 μm after annealing at 1000° C. for 12 hours). Therefore, when annealing is performed in the co-presence of a decarburization accelerator and a demanganization accelerator, under conditions of 1000° C. for 12 hours, a surface layer of α-ferrite single phase is initially formed in the very top surface (20 to 70 μm beneath the surface), after which this surface layer develops toward inside as decarburization sufficiently proceeds. By maintaining a clear thin α-ferrite single phase in the surface, {100} grains are grown by the surface energy to develop {100} textures.

If a silicon steel sheet and a separator are superposed one on another and annealed, magnitude of demanganization differs in the center portion and the edge portions of the silicon steel sheet, which sometimes causes unstable magnetic characteristics. This disadvantage can be mitigated by the use of a demanganization accelerator.

FIGS. 5 and 6 are sketches of the microstructures obtained by annealing materials containing different amounts of Mn in the presence of a decarburization accelerator and a demanganization accelerator.

FIG. 5(*a*) to FIG. 5(*e*) show the change of the microstructure when a silicon steel sheet containing 0.92% of Mn was annealed (steel sheet 0 in FIG. 12 described hereinlater) during the passage of the annealing time. Owing to the demanganizing effect, a clear region of an α-ferrite single phase is present in the vicinity of the surface during the period of first 1 hour of annealing ((a) and (b)). As the annealing time becomes longer (3 hours in (c)), grains in the surface layer rapidly grow toward the inside in the form of columns, and the columnar grains developed from the opposing surfaces come into collision at the center part of the sheet. After annealing continues for longer periods (6 to 12 hours, (d) and (e)), grain growing develops.

FIG. 6(*a*) to FIG. 6(*e*) show the change of the microstructure when a Mn-free silicon steel sheet was annealed (steel sheet O-M in FIG. 12 described hereinlater) during the passage of the annealing time. Since Mn-free steel does not provide a demanganizing effect, a clear surface layer is not formed, and decarburization proceeds uniformly over the entire thickness of the sheet. Growth of grains is at the same level between the vicinity of the surface and the inside of the sheet.

III. Annealing:

The cold rolled steel sheet to which a decarburization accelerator or a demanganization accelerator is applied as a separator in annealing may be coils or cut sheets. The former corresponds to a tight-coil annealing, and the latter corresponds to a multilayered annealing.

When the cold-rolled steel sheet is a coil, and a separator in the form of a sheet is used in practice, it is preferable that the separator is superposed on the cold-rolled steel sheet and wound into a coil. If an oxide powder is applied to the cold-rolled steel sheet, the application of the powder to the steel sheet may be carried out before the steel sheet is taken-up into a coil by the take-up apparatus. By a tight-coil annealing which uses a separator in this manner, an elongated steel sheet without undergoing buckling can be manufactured.

Annealing is preferably performed in an atmosphere in which a hydrogen gas, an inert gas, or a mixture gas of both is the major component(s), or in a vacuum. Preferably, the atmosphere is a vacuum of 100 Torr or less. More preferably, the atmosphere is a vacuum of 1 Torr or less. If the pressure of the atmosphere is in excess of 100 Torr, desired oxygen removing reaction and decarburization reactions cannot be achieved, and in addition, highly accumulated {100} textures cannot be obtained.

The annealing temperature is preferably not higher than 1300° C. It is difficult to industrially realize annealing temperatures higher than 1300° C. Preferably, the annealing is in a temperature range over 850° C. which permits co-existence of alpha+gamma two phases or a temperature range of a gamma phase in order to obtain highly accumulated {100} textures.

The soaking period for annealing is from 30 minutes to 100 hours. Soaking for 30 minutes or less results in an insufficient decarburization or demanganization. On the other hand, soaking for over 100 hours will reduce the productivity.

IV: Chemical Composition of a Cold-Rolled Silicon Steel Sheet:

The reason why the chemical composition of a cold-rolled silicon steel which is a raw material for the process of the present invention is determined as mentioned above will next be described.

C: In decarburization annealing, it is necessary that the amount of C in a starting steel sheet before undergoing decarburization annealing be not more than 1% in order to control the time required for decarburization and also to control the texture making use of a gamma-to-alpha transformation caused along with decarburization. The smaller the C content is, the better the result. The upper limit of the carbon content is preferably 0.5% and more preferably 0.2%. To secure a decarburization effect, the C content is not less than 0.01%. The C content after annealing is less than 0.01%, preferably less than 0.005%, and more preferably not more than 0.003% in order to prevent the degradation of magnetic characteristics, because residual carbon will precipitate in the α-ferrite phase as cementite, which degrades the magnetic characteristics.

Si: In order to obtain good magnetic characteristics and mechanical properties, silicon must be present in amounts of not less than 0.2%. Preferably, the Si content is not less than 1%. The upper limit of the Si content was determined to be 6.5% or less to inhibit embrittlement and reduction in magnetic flux density. The upper limit is preferably not more than 5%, and more preferably not more than 4%.

Mn: This element possesses effects of reducing eddy current loss by increasing electronic resistance, facilitating the texture control making use of a gamma-to-alpha transformation by enlarging the gamma-phase temperature range, developing {100} textures, and activating the surface of the steel sheet during annealing to accelerate decarburization. Therefore, it is necessary that this element be added in amounts not less than 0.05%. Preferably, Mn is present in amounts not less than 0.3%, and more preferably, not less than 0.5%. In any case, it is preferable that Mn be contained in an amount not more than the maximum amount which causes a substantially single α-ferrite phase at a temperature of not more than 850° C. after annealing. This is from the reason that the presence of a large amount of Mn decreases the temperature at which a substantially single α-ferrite phase is caused after completion of annealing, and therefore, the annealing temperature must be set to very low values. The word "substantially single α-ferrite phase" means as stated above.

If Si is contained in larger amounts, Mn can also be contained in larger amounts. However, in order to prevent reduction in magnetic flux, it is preferred that Mn be contained in amounts not more than 5%. Examples of other elements which may be contained without impeding the effects of the present invention include the following:

Al: not more than 0.5%,

W, V, Cr, Co, Ni, Mo: each being not more than 1%,

Cu: not more than 0.5%,

Nb: not more than 0.5%,

N: not more than 0.05%,

S: not more than 0.5%,

Sb, Se, As: each being not more than 0.05%,

B: not more than 0.005%, and

P: not more than 0.5%.

When a starting steel with a composition as described above is subjected to a decarburization annealing under tight conditions along with a separator which is composed of a decarburization accelerator solely or a combination of a decarburization accelerator and a demanganization accelerator, so that the separator is sandwiched between layers of the coil or sheets, the following effects (a) to (c) are obtained.

(a): Since the oxygen source supplied is only an oxygen generating substance which also serves as a separator in annealing, the density of the separator can be selected so that excessive amounts of oxygen will not be supplied. The density of the separator is shown by a mass per unit area, and therefore, when the separator is in the form of a sheet, density is proportional to the thickness of the sheet. Moreover, since the amount of oxygen generated varies in accordance with the annealing temperature, temperature may be used for controlling the oxygen amounts. By such a controlled oxygen supply and placement of a separator, the surface of the steel sheet can be sufficiently prevented from being oxidized.

Particularly, when the decarburization accelerator is an oxide such as $SiO_2$, $SiO_2$ does not decompose in the presence of increased amounts of oxygen. Namely, the oxidation decomposition reaction shown in scheme 1) terminates or reversely proceeds to terminate the increase of, or decrease, the amount of oxygen. By this reaction, Si in the steel sheet is controlled so as not to be oxidized. Since Mn has an oxidation potential very close to that of Si, Mn is also difficult to be oxidized.

Because the amount of oxygen in the limit area of oxidation is controlled, decarburization satisfactorily proceeds under oxygen supplying conditions where Si or Mn are not oxidized.

(b) As stated before, since the decarburization reaction possesses a feature of a solid reaction, a rapid decarburization speed can be maintained even under conditions where little amounts of oxygen are supplied. In this point, the present reaction is different from the reaction of a gas and C in the steel sheet as in open coil annealing.

(c) Due to the effects of (a) and (b) above, the decarburization reaction proceeds at a speed which raises no problems in practice, eliminating the necessity of two-stage annealing.

The silicon steel sheet is generally manufactured by the series of the steps of continuous casting—hot working—cold working.

Other than the method employing a continuous casting process, a method is used in which a thin slab having a thickness of 50 mm or less manufactured by a direct solidification method or an extremely thin sheet manufactured by a molten metal-superquenching method may be subjected to a cold rolling directly or after undergoing hot working.

Methods of cold rolling are not particularly limited as long as 10% or more reduction is possible. The reduction ratio is preferably not less than 30%, and more preferably not less than 50%. Between workings after hot working, one or more times of annealing may be placed. The term "cold rolling" is used to refer to all possible rollings at temperatures not more than 500° C. where recrystallization will not occur.

The steel sheet after undergoing cold rolling is preferably have a thickness of 5 mm or less. If the thickness is in excess of 5 mm, not only decarburization takes time until it reaches the center portion, but also eddy current loss increases. Accordingly, the thickness is 1 mm or less, and more preferably 0.5 mm or less. The lower limit of the thickness of the sheet is not particularly limited, and the sheet can be thin as long as it can be manufactured by a cold rolling process.

The effects of the method of manufacturing a silicon steel sheet according to the present invention will next be described based on Examples 1 to 8.

EXAMPLE 1

FIG. 7 is a table showing chemical compositions of 9 kinds of ingots which were manufactured by a vacuum casting process. These ingots were subjected to a hot forging to prepare a steel sheet having a thickness of 10 mm, after which each sheet was hot-rolled to a thickness of 3 mm, and then cold-rolled to a thickness of 1 mm. From each one of the resulting cold rolled steel sheets, 5 pieces of square test sheets each having a size of 250 mm×250 mm were obtained, and these test sheets were used to simulate the tight coil annealing.

In order to control the texture, fibrous decarburization accelerators containing 48 wt % $Al_2O_3$–51 wt % $SiO_2$ were placed, as separators, between layers of the 5 pieces of steel sheets to achieve a density of 0.02 g/cm$^2$, after which decarburization annealing was performed in a vacuum of $10^{-2}$ Torr, at a temperature from 925° to 1100° C., and for 3 to 72 hours.

(Measurement of the texture)

X-ray integrated intensity of each test piece which had undergone a decarburization annealing was measured at the point of ⅖ thickness beneath the surface. From the integrated intensity of the reflection from {200} planes, <100> axis density in the direction perpendicular to the sheet surface was obtained as a multiple with respect to a test piece with no orientation. For comparison, comparative examples and a commercial high grade nonoriented silicon steel sheet (JIS S-9) having a thickness of 0.5 mm were also tested in a similar manner.

FIG. 8 shows the conditions of the decarburizing annealing and the obtained characteristics after annealing. The figures in parentheses in FIG. 8 are the results of the identical test conducted using a steel sample referred to as O-M steel in FIG. 12 described hereinlater as demanganization accelerators, with the steel sample and the demanganization accelerator being superposed one on another through decarburization accelerators as shown in FIG. 3 described above.

(Analysis of C and Mn contents after annealing)

The amounts of C and Mn contained in each test piece after annealing were analyzed, and the data are shown under the heading of characteristics after annealing.

As is apparent from FIG. 8, highly accumulated {100} textures were formed though only one cycle of decarburization annealing was performed.

EXAMPLE 2

The hot-rolled steel sheet I having a thickness of 3 mm shown in FIG. 7 was cold-rolled to make a steel sheet having a thickness of 0.35 mm, from which square test sheets having a size of 200 mm×200 mm were obtained. Between five test sheets superposed one on another, decarburization accelerators were placed as a separator in annealing, and the layered body was subjected to a decarburization annealing under a surface pressure of 0.1 kg/cm$^2$ in a vacuum of 1 Torr at a temperature of 1050° C. for 24 hours.

(Measurement of magnetic characteristics)

The test sheets which had undergone a decarburization annealing were blanked to obtain 10 rings of test pieces each having an inner diameter of 33 mm and an outer diameter of 45 mm. The rings were held in a nitrogen gas atmosphere at 800° C. for 30 minutes to remove strain caused by blanking. The ten rings were superposed, on which 100 turns each of a primary coil and a secondary coil were wound to measure magnetic characteristics. The magnetic flux density was measured while applying an external magnetic field of 5000 A/m to the primary coil ($B_{50}$), and the core loss was measured when the coil was magnetized to a flux density of 1.5 T (tesla) in an alternating magnetic field of 50 Hz ($W_{15/50}$). For comparison, comparative examples and a commercial high grade nonoriented silicon steel sheet (JIS S-9) having a thickness of 0.35 mm were also tested in a similar manner.

FIG. 9 shows the specifications of the tested separators, carbon contents after annealing, and the magnetic characteristics as measured.

As is apparent from FIG. 9, excepting the case where $Al_2O_3$, which does not have a decarburization accelerating action, is solely used as a separator in annealing, all cases exhibits reduction in the carbon content after a single cycle of annealing.

EXAMPLE 3

The hot-rolled steel sheet G having a thickness of 4 mm shown in FIG. 7 was cold-rolled to make a steel sheet having a thickness of 2 mm. The resulting steel sheet was subjected to a process annealing at 900° C. for 3 minutes, followed by a cold rolling to prepare a steel sheet having a thickness of 0.35 mm, from which square test sheets having a size of 200 mm ×200 mm were obtained.

Between five test sheets superposed one on another, fibrous decarburization accelerators containing 70 wt % $Al_2O_3$–29 wt % $SiO_2$ were placed, as separators, between layers of the 5 pieces of steel sheets to achieve a density of 5 mg/cm$^2$, and the layered body was subjected to a decarburization annealing under a surface pressure of 0.1 kg/cm$^2$ with a variety of vacuum conditions at a temperature of 925° to 1100° C. for 6 to 72 hours.

The test sheets which had undergone a decarburization annealing was evaluated in a manner similar to that described in Example 2.

FIG. 10 shows conditions of the decarburizing annealing (including vacuum conditions), carbon contents after annealing, and magnetic characteristics as measured.

As is apparent from FIG. 10, according to the present method, only one cycle of annealing was effective to reduce the amount of carbon and excellent magnetizing effects were exhibited. EXAMPLE 4

The steel sheet B shown in FIG. 7 was cold-rolled to a thickness of 0.35 mm, from which square test sheets having a size of 200 mm×200 mm were obtained as described in Example 2. Between five test sheets superposed one on another, fibrous decarburization accelerators containing 50 wt % $Al_2O_3$–50 wt % $SiO_2$ were placed, as separators, between layers of the 5 pieces of steel sheets in a density of 25 mg/cm$^2$, after which the layered body was subjected to a decarburization annealing in a manner similar to that described in Example 2 at 975° C. for about 20 hours. The amounts of C and Mn in the test sheets which were in the course of undergoing the decarburization annealing were analyzed.

Figure 11:
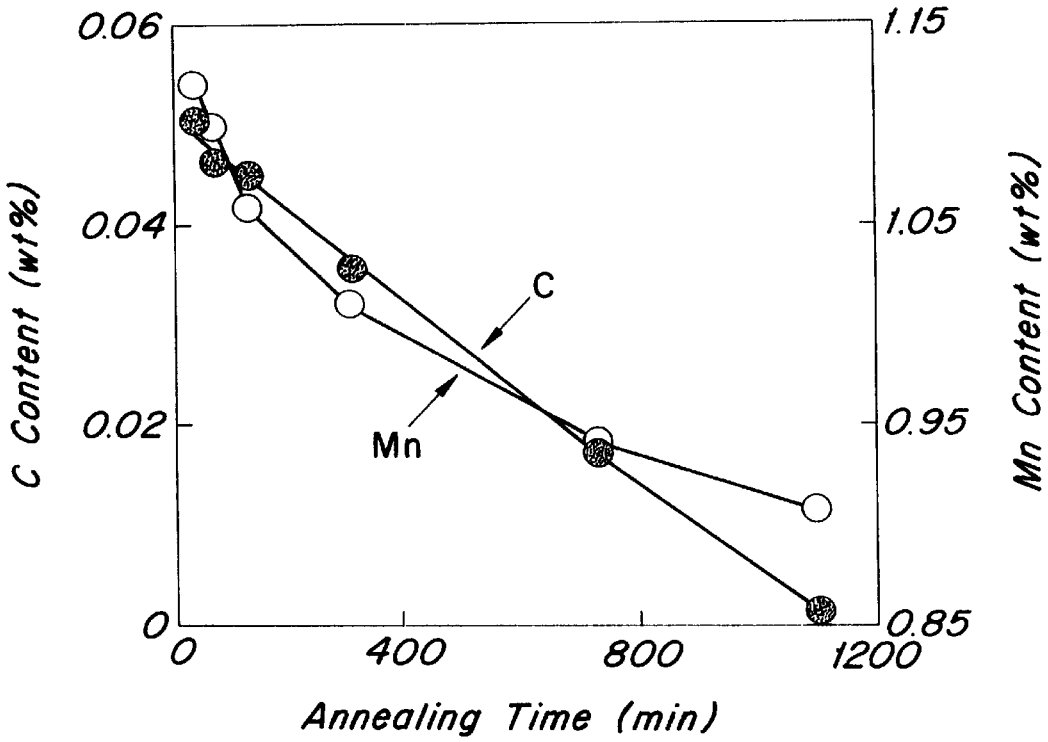
FIG. 11 is a graph which shows the effects of the annealing time on the amounts of C and Mn in Example 4.

FIG. 11 is a graph which shows the effects of the annealing time on the amounts of C and Mn in Example 4. As shown in FIG. 11, decarburization and demanganization were effectively carried out according to the present method.

EXAMPLE 5

FIG. 12 is a table which shows chemical compositions of 18 kinds of ingots which were manufactured by vacuum casting. Each ingot was hot-forged into a steel plate having a thickness of 50 mm, then the steel plate was hot-rolled to a thickness of 3 mm, followed by a cold rolling to a thickness of 0.35 mm. The steel samples indicated with H after the symbols for indicating the steel species in Comparative Examples denote steel samples which do not contain C. The proportions of the components other than C were almost common between the groups of steel species with H and those without H. The steel species O-M indicates a Mn-free steel, and it was used as a demanganization accelerator.

From each of these cold-rolled steel sheets, 5 pieces of test sheets having a size of 400 mm×400 mm were obtained and were used as test pieces for simulating a tight-coil annealing.

In order to control the texture, fibrous decarburization accelerators containing 48 wt % $Al_2O_3$–51 wt % $SiO_2$ were placed, as separators, between layers of the 5 pieces of steel sheets to achieve a density of 0.02 g/cm$^2$, after which decarburization annealing was performed in a vacuum of $10^{-3}$ Torr, at a temperature from 950° to 1150° C., and for 0.5 to 72 hours.

The composition of the fibrous decarburization accelerator was similar to that of a certain oxide called mullite. From the results of an X-ray analysis, the most part of the decarburization accelerator had an amorphous structure or a crystal structure of mullite. When it was used as a separator in annealing, in most cases, it turned to have a mixed structure of mullite and a small amount of cristobalite.

In order to confirm the effects of demanganization, 2 groups of layered bodies, a first group consisting of test sheets and decarburization accelerators (without any demanganizing substances) and a second group consisting of test sheets, decarburization accelerators, and demanganization accelerating steel sheets (O-M) were annealed.

X-ray integrated intensity of a test piece obtained from the central 100 mm×100 mm square from each test sheet having a size of 400 mm×400 mm which had undergone a decarburization annealing was measured at the point of ⅖ thickness beneath the surface. From the integrated intensity of the reflection from {200} planes, <100> axis density in the direction perpendicular to the sheet surface was obtained as a multiple with respect to a test piece with no orientation. The amounts of C and Mn, and magnetic characteristics were measured in manners similar to those described in Examples 1 and 2. For comparison, comparative examples and commercial high grade nonoriented silicon steel sheets (JIS S-9 and S-20) each having a thickness of 0.35 mm were also subjected to the same evaluation.

FIG. 13 is a table which shows the amounts of Mn and C, <100> axis density, and the magnetic characteristics as measured. The figures in parentheses in FIG. 13 show the results of the identical test conducted without using a demanganizing accelerating steel sheet.

The steel samples from J to T, which are indicated as Invention Examples in FIG. 13 exhibited higher multiples of the {200} integrated intensity, higher $B_{50}$ values, and lower $W_{15/50}$ values compared to the corresponding data of the O-M steel which did not contain Mn or the J-H to S-H steels which did not contain C, when they had undergone a decarburization annealing under the conditions shown in this table. From this, it is apparent that the invention samples possesses greatly developed {100} textures, and exhibit excellent magnetic characteristics.

When demanganization accelerators were used, the amounts of Mn in respective test sheets dropped when compared to the case where they were not used in combination, indicating that Mn had been absorbed by steel sheet O-M used as a demanganization accelerator. This also supports the mentioned results of higher multiples of the {200} integrated intensity, higher $B_{50}$ values, lower $W_{15/50}$ values, evidently developed {100} textures, and excellent magnetic characteristics.

Also, it is apparent that magnetic characteristics comparable to or more excellent than the high Si steels in Reference Examples were obtained.

From the results of FIG. 13, it is understood that {100} textures were intensely accumulated although only one cycle of decarburization annealing was performed in the present invention. EXAMPLE 6

The hot-rolled steel sheet 0 having a thickness of 3 mm shown in FIG. 12 was cold-rolled to make steel sheets having a variety of thickness (0.15 to 0.5 mm), from which square test sheets having a size of 400 mm×400 mm were obtained. $TiO_2$ powder was used as a demanganization accelerator in the present test. The test sheets and fibrous decarburization accelerators each of which consist of 70 wt % $Al_2O_3$ and 30 wt % $SiO_2$ and is combined with a variety of amounts of $TiO_2$ powder with a particle size of 10 to 50 μm were superposed one on another to achieve a density of 0.01 g/cm$^2$. The layered bodies were subjected to an annealing with soaking under a surface pressure of 0.2 kg/cm$^2$ in a vacuum of $10^{-1}$ Torr at a temperature of 1050° C. for 6 hours. The rate of temperature elevation was 1° C./min. The procedure of Example 5 was repeated to analyze the <100> axis density and amounts of C and Mn.

FIG. 14 is a table which shows the thickness of the test sheets, amounts of $TiO_2$ which had been filled, amounts of Mn and C after annealing, and <100> axis density after annealing. As is apparent from the results, the use of $TiO_2$ powder also accelerated demanganization and to develop the {100} textures intensely.

EXAMPLE 7

Using an annealed sample shown in FIG. 14 as No. 3, the texture and the magnetic anisotropy in the sheet surface were investigated.

Figure 15:
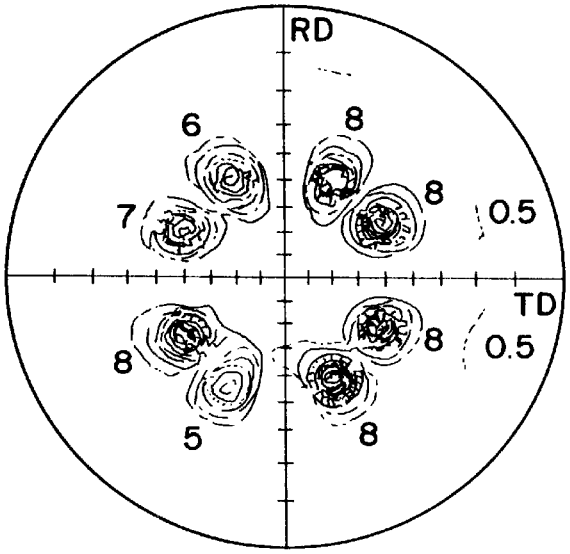
FIG. 15 is a {100} pole chart which shows a generation of an intensely oriented {100} <052> texture, and the graphs of FIGS. 16*a–b* show the relationship between the rolled direction of the material and magnetic flux or core loss.

FIG. 15 is a {110} pole chart which shows a generation of an intensely oriented {100} <052> texture. This chart was obtained by measuring the texture of the annealed sample No. 3 in FIG. 14 based on the 110 reflection of α-Fe irradiated by a Co-Kα ray. The <110> axis density was greatly large in 8 directions each inclining by 45° from the direction perpendicular to the sheet surface. From the results, it is understood that this material had strongly oriented {100} textures, and that the {100} textures had a strong plane anisotropy of a {100} <052>type.

Figure 16A:
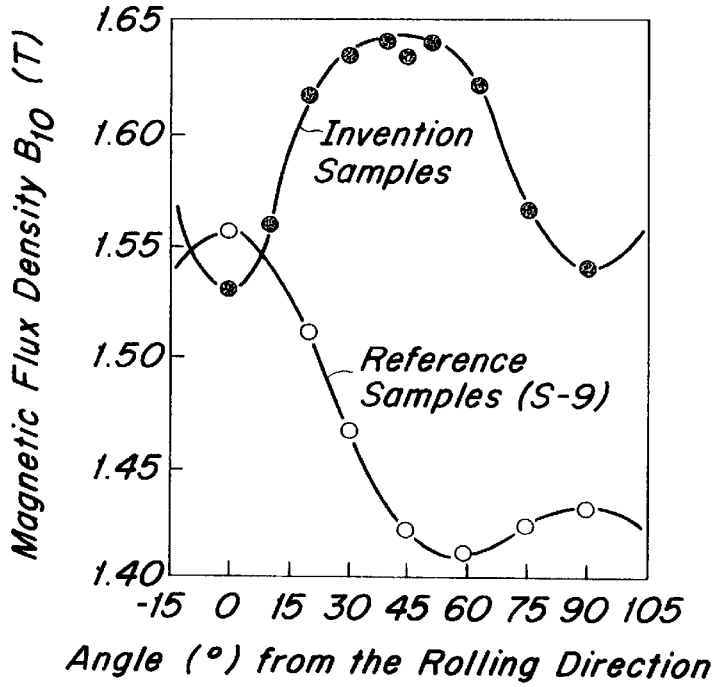
Figure 16B:
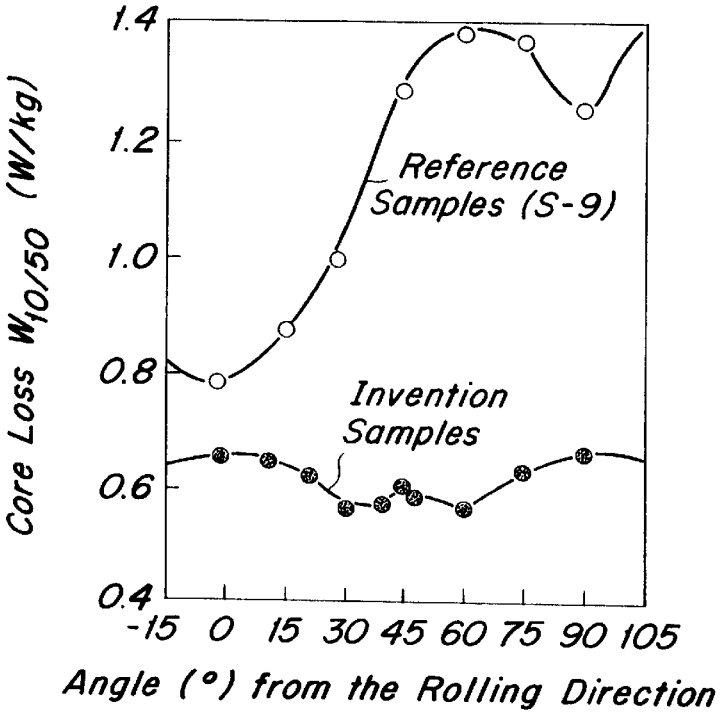

FIG. 16 shows the relationship between the rolled direction of the material and magnetic flux (a); and the relationship between the rolled direction of the material and core loss (b). Using the samples obtained by cutting out a strip of 3 cm wide and 10 cm long from the annealed sample No. 3 shown in FIG. 14 in such a manner that the longitudinal direction of the strip had a variety of angles with respect to the rolling direction and a single plate magnetization measuring apparatus, the above relationships were obtained by measuring the magnetic flux density at a magnetizing force of 1000 A/m ($B_{10}$) and the core loss under a sinusoidal magnetic flux density condition of 1.0 T and 50 Hz ($W_{10/50}$) of the sample.

From FIG. 16, this sample had a maximum magnetic flux density, and a small core loss, in the direction inclined at 45° from the rolling direction, reflecting the {100} <052>-type plane magnetic anisotropy. The absolute values of the plane magnetic anisotropy were almost the same as that of commercial nonoriented silicon steel sheet, and therefore, this is suitable for use with iron core materials such as electric motors. When single-step cold rolling methods are used, this type of plane anisotropy (a {100} <052>-type) tends to occur, whereas two-step or multi-step cold rolling methods are used along with a subsequent annealing, {100} <001>-type plane anisotropy tends to occur.

EXAMPLE 8

An ingot N shown in FIG. 12 which was manufactured by vacuum casting was hot-forged into a plate having a thickness of 30 mm. Subsequently, the steel plate was hot-rolled to a thickness of 3 mm, annealed in an nitrogen atmosphere at 900° C. for 3 minutes, and cold-rolled to a thickness of 0.5 mm. In order to simulate a tight-coil annealing, test sheets having a size of 400 mm×400 mm were cut out from the cold-rolled sheet. As a separator in annealing, a fibrous decarburization accelerator consisting of 20 wt % $Al_2O_3$ and 80 wt % $SiO_2$ and was applied to the test sheets at a density of 0.005 g/cm$^2$, and in addition, $SiO_2$ powder and $TiO_2$ powder both having a diameter in the range from 5 to 100 $\mu$m were further placed each at a density of 3 mg/cm$^2$ between the layers of the test sheet. To the resulting layered body, a surface pressure of 0.2 kg/cm$^2$ was applied.

Thereafter it was subjected to a soaking in a vacuum of $10^{-2}$ Torr, at 1000° C. for 10 hours. The rate of temperature elevation was 1° C./min. X-ray integrated intensity of a test piece which had undergone an annealing was measured at the point of ⅔ thickness beneath the surface. {200} integrated intensity was obtained as a multiple with respect to a test piece with no orientation. Moreover, the amounts of C and Mn in the test samples which had undergone an annealing were analyzed, and 10 rings each having an inner diameter of 33 mm and an outer diameter of 45 mm were blanked from each test sample. The rings were held at 800° C. for 30 minutes in a nitrogen atmosphere to remove strain caused by blanking.

The ten rings were superposed, on which 100 turns each of a primary coil and a secondary coil were wound to measure magnetic flux densities ($B_{10}$ and $B_{50}$) while applying external magnetic fields of 1000 A/m and 5000 A/m, and core losses ($W_{10/50}$ and $W_{15/50}$) when the coils were magnetized to flux densities of 1 T (tesla) and 1.5 T in an alternating magnetic field of 50 Hz.

Figure 17:
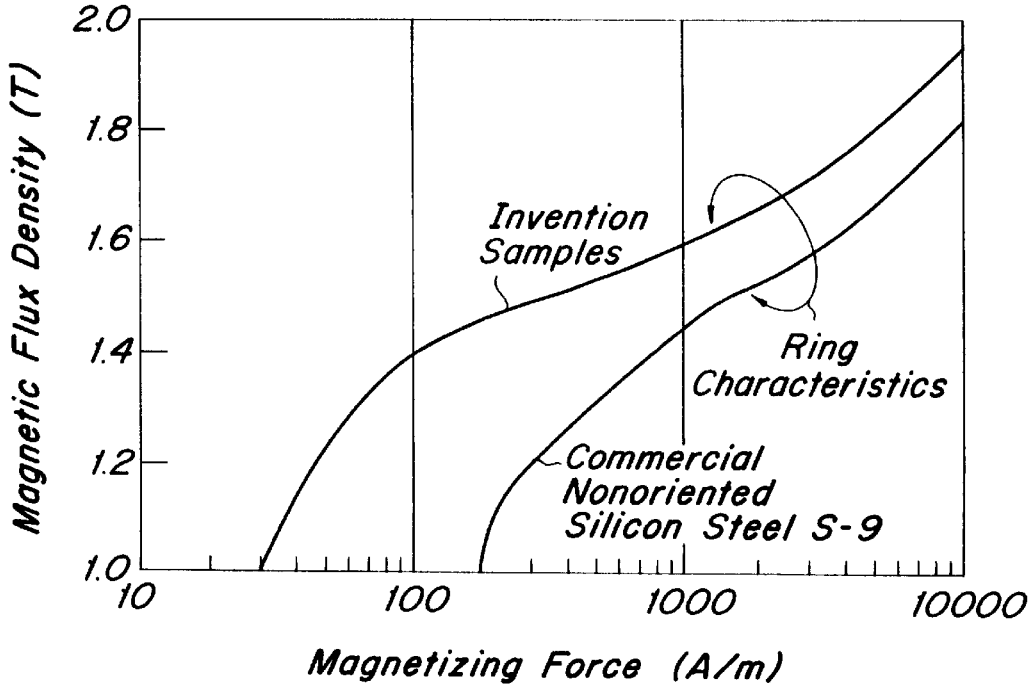
FIG. 17 is a graph which shows a magnetization curve of a representative sample in Example 8 along with the curve obtained from a comparative material (commercial nonoriented magnetic steel sheet S-9)

FIG. 17 is a graph which shows a magnetization curve of a sample along with the curve obtained from a comparative material (commercial nonoriented magnetic steel sheet S-9), and FIG. 18 is a table which shows the amounts of Mn and C, <100> axis density, and magnetic characteristics after annealing. From the results in these Figures, it is understood that the material according to the invention exhibits magnetic characteristics superior to these of comparative material.

Industrial Applicability:

According to the method of manufacturing a silicon steel sheet of the present invention, silicon steel sheets with highly oriented {100} textures which exhibit excellent magnetic characteristics can be effectively manufactured. Moreover, since the annealing employed is a tight-coil annealing or a multi-layer annealing in which a separator is used buckling of the steel sheet is prevented and elongated materials can be manufactured. Thus, the invention is useful in the field of the manufacture of steels.

We claim:

1. A method of manufacturing a silicon steel with excellent magnetic characteristics which comprises subjecting a cold-rolled silicon steel sheet containing, on a weight basis, not more than 1% of C, 0.2 to 6.5% of Si, and 0.05 to 5.0% of Mn to a tight-coil decarburization annealing or a multilayer decarburization annealing in a vacuum of 100 Torr or less, together with a substance which accelerates decarburization and which serves as a separator in decarburization annealing.

2. A method of manufacturing a silicon steel sheet with excellent magnetic characteristics which comprises subjecting a cold-rolled silicon steel sheet containing, on a weight basis, not more than 1% of C, 0.2 to 6.5% of Si, and 0.05 to 5.0% of Mn to a tight-coil decarburization annealing or a multilayer decarburization annealing together with a substance which accelerates decarburization and a substance which accelerates demanganization, both substances serving as separators in decarburization annealing.

3. The method of claim 1, wherein the vacuum is 1 Torr or less.

4. The method of claim 1, wherein the substance comprises $SiO_2$, $Cr_2O_3$, FeO, $Na_2CO_3$ and mixtures thereof.

5. The method of claim 1, wherein the substance generates oxygen which accelerates decarburization during the annealing step.

6. The method of claim 1, wherein the substance comprises a fibrous material or sheet composed of fibers.

7. The method of claim 1, wherein the annealing step is a single step carried out at a temperature of 850° to 1300° C.

8. The method of claim 1, wherein the silicon steel sheet has a microstructure consisting essentially of α-ferrite after the annealing step.

9. The method of claim 1, wherein the C in the silicon steel sheet after the annealing step is ≦0.01%.

10. The method of claim 1, wherein the C in the silicon steel sheet after the annealing step is ≦0.001%.

11. The method of claim 1, wherein the silicon steel sheet includes ≦0.5% Al, ≦1% each of W, V, Cr, Cu, Ni and Mo, ≦0.5% Cu, ≦0.5% Nb, ≦0.05% N, ≦0.5% S, ≦0.05% each of Sb, Se, and As, ≦0.005% B and ≦0.5% P.

12. The method of claim 1, wherein carbon is removed from the silicon steel sheet via a solid state reaction during the annealing step.

13. The method of claim 2, wherein the substance generates oxygen which accelerates decarburization during the annealing step.

14. The method of claim 2, wherein the annealing step is a single step carried out at a temperature of 850° to 1300° C.

15. The method of claim 2, wherein the silicon steel sheet has a microstructure consisting essentially of α-ferrite after the annealing step.

16. The method of claim 2, wherein the C in the silicon steel sheet after the annealing step is ≦0.01%.

17. The method of claim 2, wherein the C in the silicon steel sheet after the annealing step is ≦0.001%.

18. The method of claim 2, wherein the silicon steel sheet includes ≦0.5% Al, ≦1% each of W, V, Cr, Cu, Ni and Mo, ≦0.5% Cu, ≦0.5% Nb, ≦0.05% N, ≦0.5% S, ≦0.05% each of Sb, Se, and As, ≦0.005% B and ≦0.5% P.

* * * * *